US006696627B2

(12) United States Patent
Florath et al.

(10) Patent No.: US 6,696,627 B2
(45) Date of Patent: Feb. 24, 2004

(54) SUPPORT STRUCTURE FOR A STRINGED INSTRUMENT

(75) Inventors: Uwe Florath, Omenalahdentie 26, FIN-4500 Kellokoski (FI); Kauko Liikanen, Helsinki (FI)

(73) Assignees: Liikanen Musical Instruments Ky, Helsinki (FI); Uwe Florath, Kellokoski (FI)

( * ) Notice: Subject to any disclaimer, the term of this patent is extended or adjusted under 35 U.S.C. 154(b) by 0 days.

(21) Appl. No.: 10/239,126

(22) PCT Filed: Mar. 23, 2001

(86) PCT No.: PCT/FI01/00290

§ 371 (c)(1),
(2), (4) Date: Oct. 7, 2002

(87) PCT Pub. No.: WO01/73746

PCT Pub. Date: Oct. 4, 2001

(65) Prior Publication Data

US 2003/0106408 A1 Jun. 12, 2003

(30) Foreign Application Priority Data

Mar. 24, 2000 (FI) ..... 20000689

(51) Int. Cl.[7] ..... G10D 3/00
(52) U.S. Cl. ..... 84/290; 84/291
(58) Field of Search ..... 84/290, 291, 267, 84/270, 274, 275, 280, 292

(56) References Cited

U.S. PATENT DOCUMENTS

| | | | | |
|---|---|---|---|---|
| 2,260,066 A | | 6/1941 | Vitalis | |
| 3,974,730 A | * | 8/1976 | Adams, Jr. | 84/291 |
| 4,362,079 A | * | 12/1982 | Kelly | 84/291 |
| 4,903,567 A | | 2/1990 | Justus | |
| 4,955,274 A | | 9/1990 | Stephens | |
| 5,883,317 A | | 3/1999 | Kornprobst | |

FOREIGN PATENT DOCUMENTS

| | | |
|---|---|---|
| FR | 2635399 | 7/1990 |
| GB | 1543589 | 4/1979 |

OTHER PUBLICATIONS

"20000689" Finnish Search Report dated Sep. 25, 2000.

* cited by examiner

*Primary Examiner*—Kimberly Lockett
(74) *Attorney, Agent, or Firm*—Finn T. Simmensen, Esq.; Marshall A. Lerner, Esq.; Kleinberg & Lerner, LLP

(57) ABSTRACT

A support structure for stiffening one or more vibrating plates of an acoustic stringed instrument: at least one sheet-like piece supported at least partly at a distance from the plate by means of one or more formed pieces arranged between the sheet-like piece and the plate to be stiffened. The entity formed by the sheet-like piece and the plate to be stiffened, together, is the shape of a lens thinning towards the edges in cross-section.

8 Claims, 2 Drawing Sheets

SUPPORT STRUCTURE FOR A STRINGED INSTRUMENT

This application claims the benefit of PCT International Application No. PCT/FI01/00290, filed on Mar. 23, 2001 and Finnish Patent Application No. 20000689, filed Mar. 24, 2000, the priority of which is claimed.

BACKGROUND OF THE INVENTION

1. Field of the Invention

The invention relates to a support structure for stiffening one or more vibrating plates of an acoustic stringed instrument.

2. Description of the Related Art

With various acoustic stringed instruments, the aim is to make the vibrating plates of the instrument, especially the sound board and/or the back, as thin and as easily resonating elements as possible. But then again, certain stiffness requirements are set for this type of elements. The sound board, especially, should be sufficiently stiff and firm to withstand the strain caused by the strings.

In order for the instrument to produce an acoustic sound of sufficient volume and to be sensitively sounding, the mass of the vibrating part should be as small as possible. An even, pure tone over the instrument's entire range of sound requires careful control of the vibrating parts, especially of the resonances of the sound board and the back.

Extremely contradictory requirements are thus set for the vibrating plates. On the one hand they should be easily resonating, and on the other stiff. Attempts have been made to solve this problem by using different kinds of support laths at suitable points.

By using support laths, it has been possible to make instruments meeting extremely high standards. However, due to the excessive mass amounting from them, not enough laths can be included to be able to tune the tone of the instrument over the entire range of sound in the best possible way.

SUMMARY OF THE INVENTION

The object of the invention is to eliminate these disadvantages.

To achieve this object, the support structure relating to the invention is characterised in that the support structure is formed by at least one sheet-like piece which is supported at least partly at a distance from the plate to be stiffened by means of one or more formed pieces arranged between the sheet-like piece and the plate to be stiffened, and that the entity formed by the sheet-like piece and the plate to be stiffened together is the shape of a lens thinning towards the edges in cross-section.

By means of the invention is achieved a lighter structure which is well controlled as concerns resonance, whereby the sound volume of the instrument increases and the purity of tone improves. Due to the smoother inner surfaces, the sound box functions more efficiently, thus also improving the quality of the tone.

It should be noted in particular, that when using the support structure relating to the invention, the actual plate to be stiffened can be made thinner than conventional structures.

Further preferable developments of the invention are disclosed in the dependent claims.

BRIEF DESCRIPTION OF THE DRAWINGS

For a further understanding of the objects and advantages of the present invention, reference should be had to the following detailed description, taken in conjunction with the accompanying drawing, in which like parts are given like reference numbers and wherein.

DESCRIPTION OF THE PREFERRED EMBODIMENTS

Figure 1:
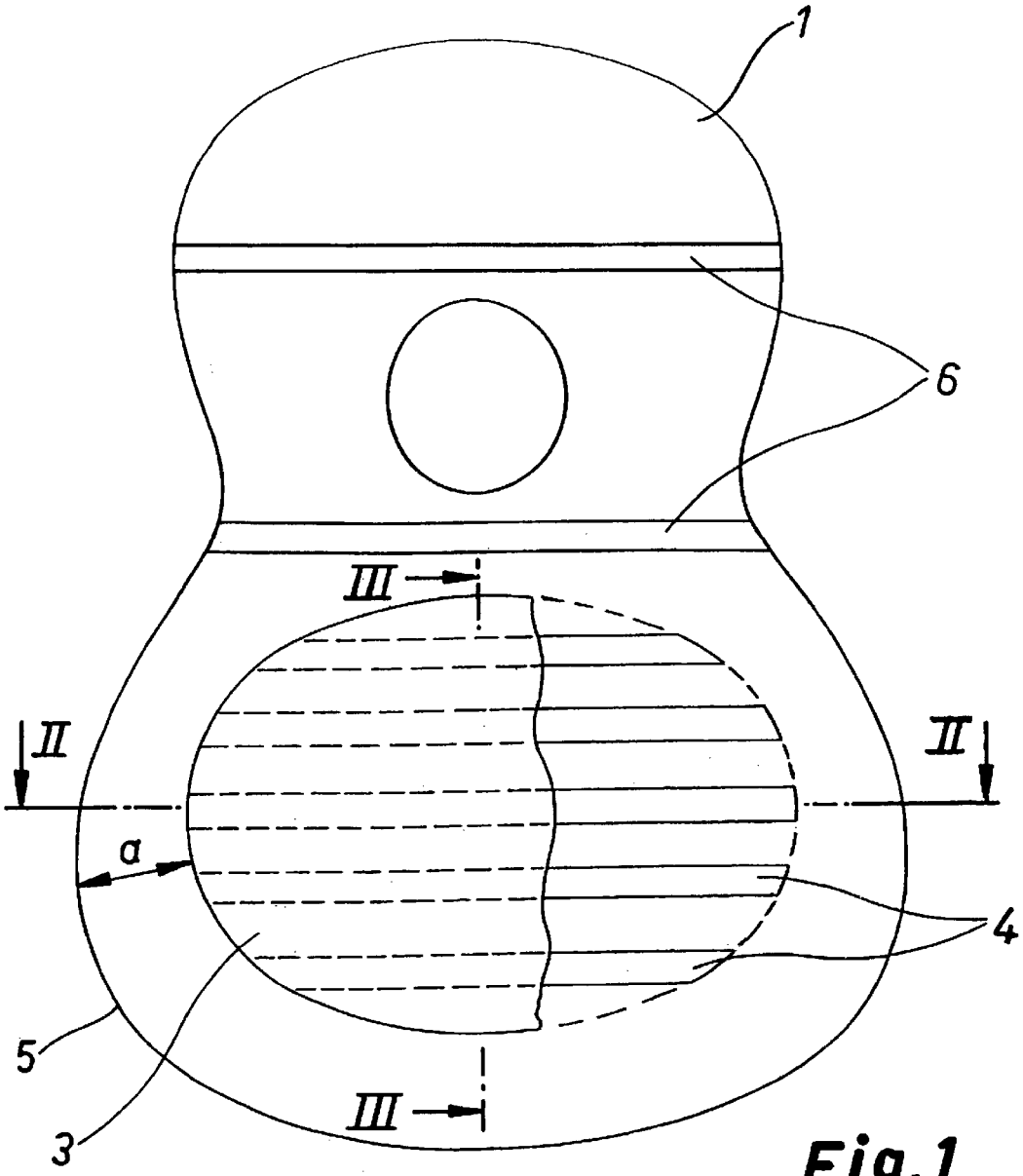
FIG. 1 is a diagrammatic view of a sound board of a guitar as seen on the inside of the sound box and equipped with the support structure relating to the invention.

The invention will now be described with reference to FIG. 1, which shows diagrammatically the sound board 1 of the guitar as seen on the inside of the sound box and equipped with the support structure relating to the invention. The support structure is formed by at least one sheet-like piece 3 which is supported at least partly at a distance from the plate (sound board) 1 to be stiffened. To achieve a suitable stiffness, one or more formed pieces 4 are arranged between the sheet-like piece 3 and the plate 1 to be stiffened. In the example shown in the drawing, laths 4 act as formed pieces. A formed piece 4 may be made of, for example, wood or of a synthetic material.

Figure 2:
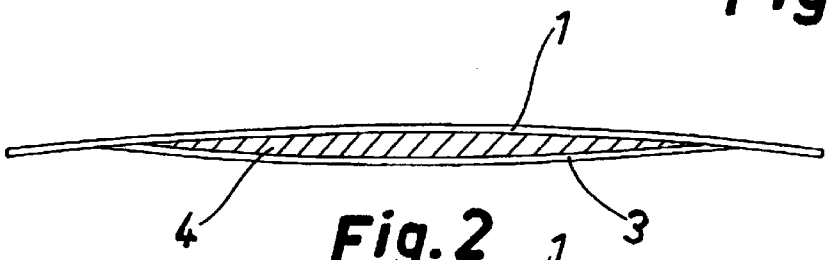
FIG. 2 is a section thereof along line II—II of FIG. 1.
Figure 3:
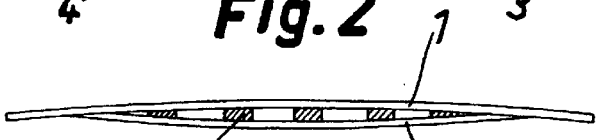
FIG. 3 is a section thereof along line III—III of FIG. 1.

The entity formed by the sheet-like piece 3 and the plate 1 to be stiffened together is the shape of a lens thinning towards the edges in cross-section, as seen best in FIGS. 2 and 3. In that case, the sheet-like piece 3 to be attached to the plate 1 to be stiffened will not form edges protruding sharply from the plate 1, but instead the sheet-like piece 3 and the plate 1 to be stiffened are joined with each other smoothly.

The sheet-like piece 3 is attached on its edges and by means of the laths 4 firmly to the plate 1 being stiffened.

It should be emphasised in particular that the sheet-like piece 3 does not have to cover the formed piece 4 entirely, especially when the formed piece already forms a uniform piece as such, but instead there may be several spaced apart sheet-like pieces 3 on top of the formed piece 4. In such a case, the sheet-like pieces 3 may be in the shape of, for example, lath-like pieces of even width and relatively thin in thickness.

The sheet-like piece 3 is smaller than the plate 1 to be stiffened. The sheet-like piece 3 is fitted in such a way with respect to the plate 1 to be stiffened that the sheet-like piece 3 is at all points at a distance a from the outer edge 5 of the plate 1 to be stiffened. The magnitude of distance a may be different at different points. The sheet-like piece 3 does not, therefore, have to be symmetrical with the plate 1 to be stiffened, nor does it have to be located symmetrically with respect to the plate 1 being stiffened.

In principle, the larger the sheet-like piece 3 is dimensioned with respect to the plate 1 being stiffened, the stiffer the plate 1 to be stiffened will be. Stiffness may obviously also be increased by increasing the thickness of the laths 4.

The sheet-like piece 3 is preferably attached to the plate 1 to be stiffened on the inside of the sound box. It is, however, also possible to arrange this in such a way that the sheet-like piece 3 is fitted on the visible side of the plate 1 to be stiffened.

The sheet-like piece 3 and the plate 1 to be stiffened can be made of different materials, for example, different kinds of wood, in which case the direction of the grain may be different in the sheet-like piece 3 and the plate 1 to be stiffened. The quality of the tone can thus be tuned by using different materials in the parts 1, 3. The material used for the parts 1, 3 may naturally also be the same in both.

If necessary, one or more support laths 6 may in addition be attached to the plate 1 to be stiffened in order to obtain an optimal structure. The support lath 6 may be completely outside the sheet-like piece 3, but it may also be partly or completely on top of the sheet-like piece 3.

Figure 4:
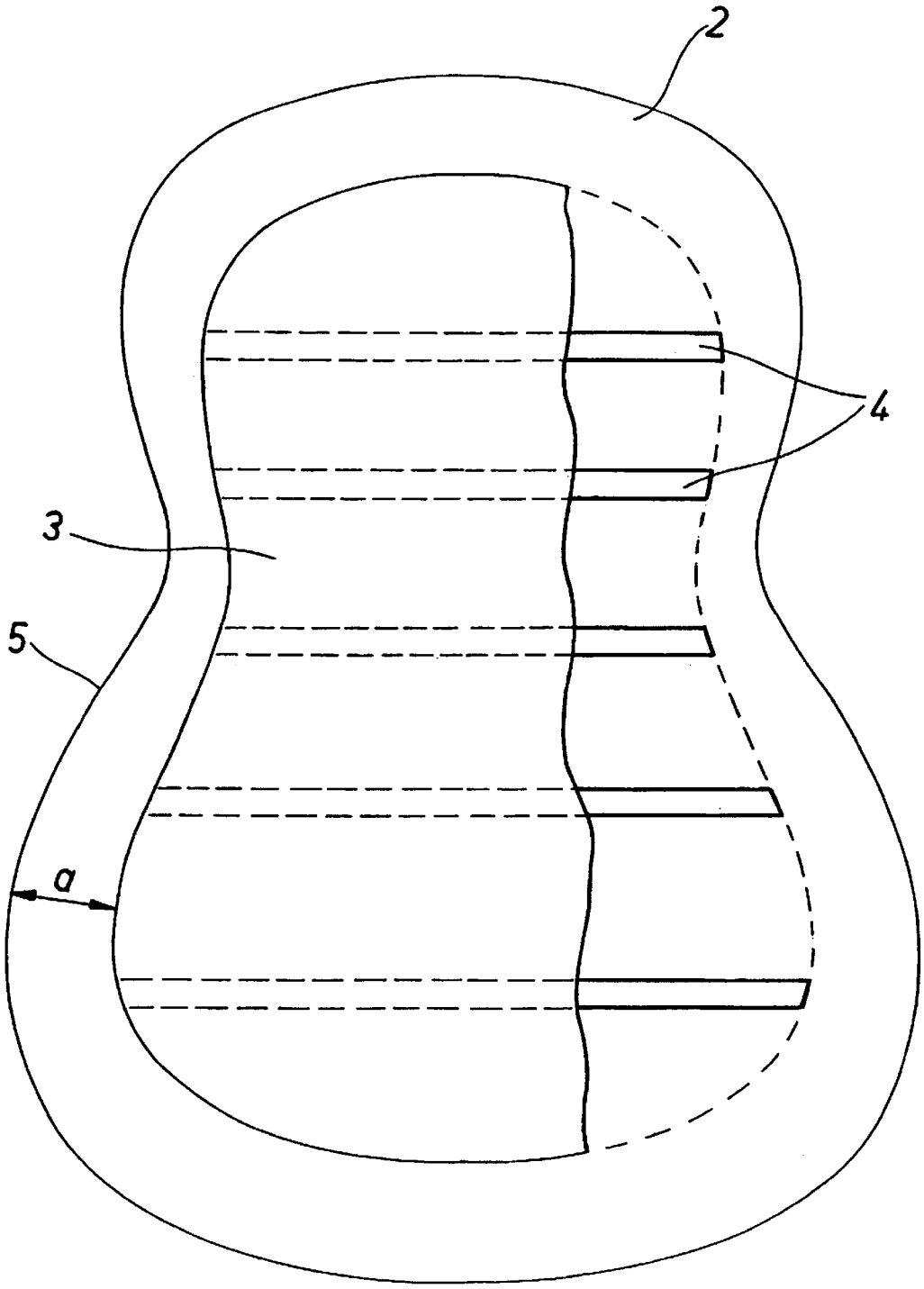
FIG. 4 is a diagrammatic view the back of the guitar as seen on the inside of the sound box and equipped with the support structure relating to the invention.

FIG. 4 further shows diagrammatically the back of the guitar equipped with the support structure relating to the invention. Here, the sheet-like piece 3 is considerably larger than on the sound board shown in FIG. 1. The size of the sheet-like piece 3 and the number of pieces 3 can, however, be selected in accordance with the respective structure of the stringed instrument in question.

Although the invention has been described above only with reference to a guitar, the support structure relating to the invention is also applicable to other acoustic stringed instruments, such as mandolins, zithers, pianos, etc. While the foregoing detailed description has described several embodiments of a support structure for a stringed instrument in accordance with the present invention, it is to be understood that the above description is illustrative only and not limiting of the disclosed invention. Indeed, it will be appreciated that the embodiments discussed above and the virtually infinite embodiments that are not mentioned could easily be within the scope and spirit of the present invention. Thus, the present invention is to be limited only by the claims as set forth below.

What is claimed is:

1. A support structure for stiffening at least one vibrating plate of an acoustic stringed instrument, the support structure being formed by at least one sheet-like piece, said sheet-like piece being supported at least partly at a distance from said plate to be stiffened by means of at least one formed piece arranged between said sheet-like piece and said plate to be stiffened; the entity formed by said sheet-like piece and said plate to be stiffened together being in the shape of a lens thinning towards the edges in cross-section.

2. A support structure as set forth in claim 1, comprising at least one lath arranged between said sheet-like piece and said plate to be stiffened.

3. A support structure as set forth in claim 1, said sheet-like piece being attached firmly to said plate to be stiffened.

4. A support structure as set forth in claim 1, said sheet-like piece being smaller than said plate to be stiffened.

5. A support structure as set forth in claim 4, said sheet-like piece being fitted in such a way with respect to said plate to be stiffened that said sheet-like piece is at all points at a distance from said outer edge of said plate to be stiffened.

6. A support structure as set forth in claim 1, said sheet-like piece being attached to said plate to be stiffened on the inside of the sound box.

7. A support structure as set forth in claim 1, said sheet-like piece and said plate to be stiffened being made of different materials.

8. A support structure as set forth in claim 1, comprising one or more support laths attached to said plate to be stiffened.

* * * * *